US005873736A

United States Patent [19]

Harrison

[11] Patent Number: 5,873,736

[45] Date of Patent: Feb. 23, 1999

[54] PRENATAL MUSIC BELT

[76] Inventor: Kevin Harrison, 2100 Plum St., Montgomery, Ala. 36107

[21] Appl. No.: 847,167

[22] Filed: Apr. 30, 1997

[51] Int. Cl.[6] ..... H04R 1/02

[52] U.S. Cl. ..... 434/322; 224/664; 600/27; 381/151

[58] Field of Search ..... 224/681, 662, 224/664; 434/319, 322; 600/27, 28; 381/90, 150, 151

[56] References Cited

U.S. PATENT DOCUMENTS

| | | | |
|---|---|---|---|
| 4,830,007 | 5/1989 | Stein | 381/151 |
| 4,934,998 | 6/1990 | Thomas | 600/27 |
| 5,491,756 | 2/1996 | Francais | 381/90 |

*Primary Examiner*—Richard J. Apley
*Assistant Examiner*—Glenn E. Richman
*Attorney, Agent, or Firm*—American Innovations Inc.

[57] ABSTRACT

A new prenatal music belt for sharing the soothing effects of music and the like with an unborn child. The inventive device includes an elongated, elastic belt with a buckle at one end of the belt for readily permitting adjustments to the size of the belt. A pair of pockets are attached by loops to the belt so that the position of the pockets can be adjusted to any position along the belt. The pockets are sized and shaped for retaining earphones from a sound playback device therein, with the earphone being directed towards the mother's abdomen so that sound from the earphones is directed towards the fetus. The sound playback device is attached by a clip to the belt at any position therealong which is comfortable to the wearer. The pockets are closed by VELCRO/hook and loop type fasteners in order retain the earphones therein.

7 Claims, 1 Drawing Sheet

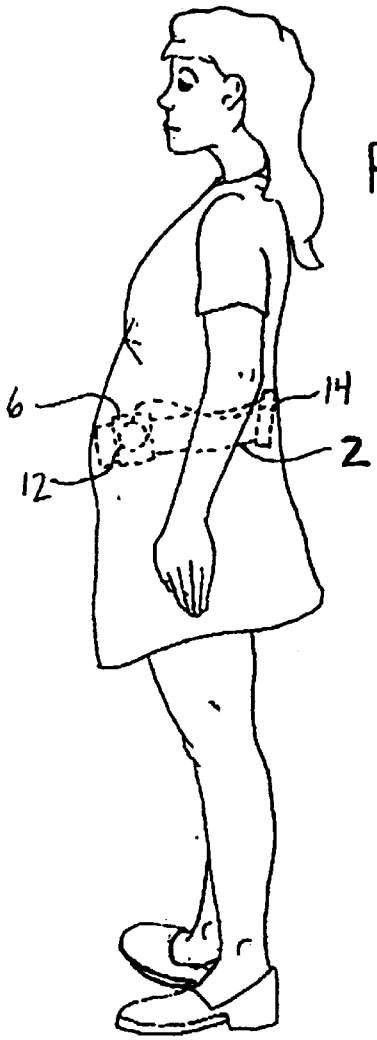
FIG. 1
FIG. 2
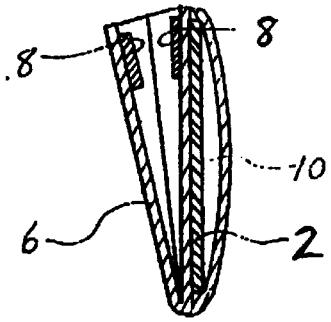
FIG. 3
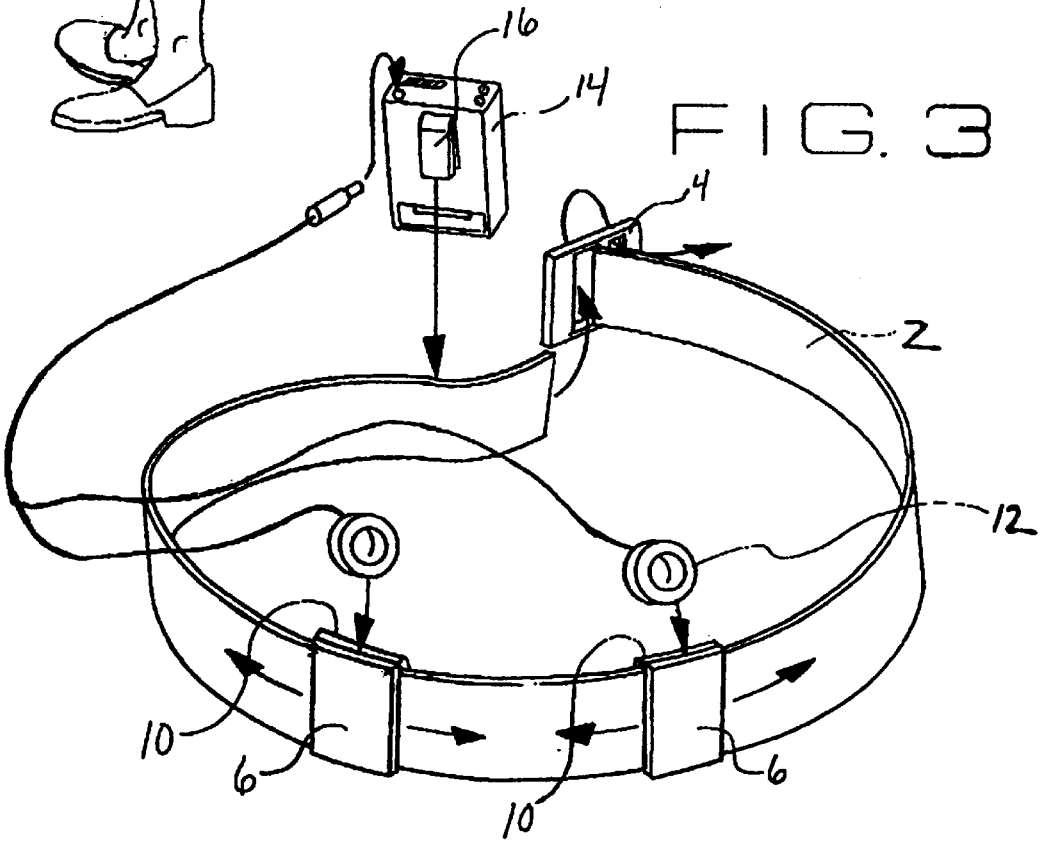

PRENATAL MUSIC BELT

BACKGROUND OF THE INVENTION

1. Field of the Invention

The present invention relates to a belt which is worn by pregnant mother's for communicating sounds, such as music and the like, to the unborn child within the mother's womb.

2. Description of the Prior Art

The use of a belt device which is worn by expectant mother's to communicate sounds to the unborn child is known from U.S. Pat. No. 4,798,539 to Henry et al. The belt in Henry et al is worn around the pregnant mother's abdomen and is secured around the mother using VELCRO. The belt is either provided with a pocket for retaining a sound playback device and associated speakers therein, or the speakers are supported by the belt and connected with a remote sound playback device. However, a belt which retains the sound playback device therein is heavy and uncomfortable to wear, limits the playback device which is used to one which is able to fit within the pocket, and the playback device can only be adjusted on the belt after the belt is first removed from the wearer. Additionally, the belt of Henry et al is not designed to support the remote sound playback device thereon, so that the playback device must either be carried by the mother or a separate pack utilized to hold the playback device. The position of the speakers in Henry et al is not adjustable either, so that the belt can not be tailored to different sized women. Further, since a woman's waist size changes during pregnancy, and the waist size of each individual pregnant women varies, the VELCRO and other disclosed attachments of Henry et al do not permit sufficient variation in the belt size to accommodate different waist sizes.

Further related prior art includes U.S. Pat. No. 5,353,975; U.S. Pat. No. 5,121,865; Des. U.S. Pat. No. 278,761; U.S. Pat. No. 4,764,962; U.S. Pat. No. 2,688,752; U.S. Pat. No. 4,722,464; U.S. Pat. No. 4,569,465; and U.S. Pat. No. 4,411,267.

While these prior devices fulfill their respective, particular objectives and requirements, the aforementioned patents do not disclose a new prenatal music belt. The inventive device includes an elongated, elastic belt with a buckle at one end of the belt for readily permitting adjustments to the size of the belt. A pair of pockets are attached by loops to the belt so that the position of the pockets can be adjusted to any position along the belt. The pockets are sized and shaped for retaining earphones from a sound playback device therein, with the earphone being directed towards the mother's abdomen so that sound from the earphones is directed towards the fetus. The sound playback device is attached by a clip to the belt at any position therealong which is comfortable to the wearer. The pockets are closed by VELCRO/hook and loop type fasteners in order retain the earphones therein.

In these respects, the prenatal music belt according to the present invention substantially departs from the conventional concepts and designs of the prior art, and in so doing provides an apparatus primarily developed for the purpose of sharing the soothing effects of music and the like with an unborn child.

SUMMARY OF THE INVENTION

The general purpose of the present invention, which will be described subsequently in greater detail, is to provide a new prenatal music belt device which has many of the advantages of the belt devices mentioned previously and many novel features that result in a new prenatal music belt device which is not anticipated, rendered obvious, suggested, or even implied by any of the prior art belt devices, either alone or in any combination thereof.

To attain this, the present invention generally comprises an elongated, elastic belt with a buckle at one end of the belt for readily permitting adjustments to the size of the belt. A pair of pockets are attached by loops to the belt so that the position of the pockets can be adjusted to any position along the belt. The pockets are sized and shaped for retaining earphones from a sound playback device therein, with the earphone being directed towards the mother's abdomen so that sound from the earphones is directed towards the fetus. The sound playback device is attached by a clip to the belt at any position therealong which is comfortable to the wearer. The pockets are closed by VELCRO/hook and loop type fasteners in order retain the earphones therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is therefore a primary object of the invention to provide a way to share the soothing effects of music with an unborn child. A further object of the present invention is to provide a prenatal music belt which is comfortable to wear and does not bind the wearers waist. An even further object of the invention is to provide a prenatal music belt which is adjustable to accommodate different waist sizes, and where the location of the sounds can be adjusted to different positions around the wearers waist. An additional object of the present invention is to provide a prenatal music belt which securely holds earphones therein so that the sound coming therefrom is always directed towards the unborn child.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a view of a pregnant woman wearing the prenatal music belt around her waist.

FIG. 2 is a cross sectional view of one of the pockets.

FIG. 3 is a elevated perspective view of the prenatal music belt.

DESCRIPTION OF THE PREFERRED EMBODIMENT

With reference now to the drawings, and in particular to FIGS. 1 through 3 thereof, a new prenatal music belt embodying the principles and concepts of the present invention will be described.

As best illustrated in FIGS. 1 through 3, the prenatal music belt comprises an elongated belt member 2 made from an elastic material, so as to allow the wearer to pull the belt member snug around her waist and to permit the belt member 2 stretch and move as the wearer moves. A conventional buckle 4 is secured to one end of the belt to secure the belt member 2 around the mother's waist and to permit adjustments to the size of the belt member. A pair of cloth pockets 6 are attached to the belt member 2 by loops 10 secured to the back of the pockets. The loops 10 are disposed around the belt member, as shown in FIG. 2, and permit adjustments of the pockets 6 along the length of the belt member 2. The pockets 6 are not connected together such that they can be adjusted relative to each other. The details of the pockets are shown in FIG. 2, where it can be seen that the pockets 6 include an upwardly facing slot which is closed by VELCRO/hook and loop fasteners 8.

The pockets 6 are sized and shaped so as to retain earphones 12 therein, the earphones being connected to a sound playback device 14, such as a portable cassette and/or radio player. The earphones 12 are retained within the pockets in a direction so as to direct the sound coming therefrom towards the mother's abdomen and the unborn child. The sound playback device 14 includes a belt clip 16 connected thereto, so as to permit attachment of the device to the belt member 2. The music belt could either be sold with a sound playback device and earphones, or else sold without a sound playback device such that the wearer would utilize a previously purchased sound playback device.

To use the prenatal music belt, the belt member 2 is secured around the mother's waist. The earphones 12 are inserted into the pockets 6 and the pockets are adjusted to a comfortable position along the belt member. The sound playback device 14 is also secured to the belt using the clip 16 in any position which is comfortable to the mother. When the sound playback device is turned on, the sound therefrom is directed from the earphones towards the unborn child, without the surrounding area being unduly disturbed by the sounds.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A system for transmitting sounds to an unborn fetus within a mother's womb, comprising:

a sound playback device having a pair of earphones connected thereto for broadcasting sounds therefrom, said sound playback device including a clip attached thereto; and an elongated, elastic belt having a buckle secured thereto for permitting adjustable securement of the belt around the mother's abdomen, and a pair of pockets attached to the elastic belt, each said pocket being sized so as to retain a respective one of said earphones therein with each earphone facing toward the mother's abdomen, and each said pocket including attachment means thereon for permitting attachment of each pocket to the belt in a manner which permits adjustment of each pocket along the length of the belt.

2. The system according to claim 1, wherein each of said attachment means comprises a loop secured to the respective pocket and disposed around the belt.

3. The system according to claim 1, wherein said pockets are separate from each other such that said pockets can move relative to each other.

4. The system according to claim 3, wherein said pockets are made from a cloth material, and each said pocket includes an upward facing slot.

5. The system according to claim 4, wherein each said pocket includes means for selectively closing the respective said slot.

6. The system according to claim 5, wherein said means for selectively closing comprises hook and loop fasteners.

7. The system according to claim 1, wherein the clip is disposed over said elastic belt in order to removably secure the sound playback device to the elastic belt.

* * * * *